US011982152B2

(12) United States Patent
Krüger

(10) Patent No.: US 11,982,152 B2
(45) Date of Patent: May 14, 2024

(54) WIRELINE PLUG SYSTEM

(71) Applicant: WELLTEC A/S, Allerød (DK)

(72) Inventor: Christian Krüger, Allerød (DK)

(73) Assignee: WELLTEC A/S, Allerød (DK)

( * ) Notice: Subject to any disclaimer, the term of this patent is extended or adjusted under 35 U.S.C. 154(b) by 84 days.

(21) Appl. No.: 17/704,530

(22) Filed: Mar. 25, 2022

(65) Prior Publication Data

US 2022/0307342 A1 Sep. 29, 2022

(30) Foreign Application Priority Data

Mar. 26, 2021 (EP) ..... 21165336

(51) Int. Cl.
*E21B 33/13* (2006.01)
*E21B 33/12* (2006.01)

(52) U.S. Cl.
CPC ..... *E21B 33/13* (2013.01); *E21B 33/1208* (2013.01)

(58) Field of Classification Search
CPC .. E21B 33/13; E21B 33/1208; E21B 33/1212; E21B 33/1275; E21B 33/134; E21B 23/06
See application file for complete search history.

(56) References Cited

U.S. PATENT DOCUMENTS 3,460,625 A 8/1969 Hart et al.
5,361,834 A * 11/1994 Cox ..... E21B 23/04115 166/138
5,404,946 A * 4/1995 Hess ..... E21B 33/1275 166/325
5,577,560 A * 11/1996 Coronado ..... E21B 23/08 166/66.4
2014/0158371 A1* 6/2014 Hallundb ..... E21B 23/14 166/377

(Continued)

OTHER PUBLICATIONS

Extended Search Report for EP21165336.5, dated Sep. 20, 2021, 9 pages.

(Continued)

*Primary Examiner* — Steven A MacDonald
(74) *Attorney, Agent, or Firm* — Nixon & Vanderhye P.C.

(57) ABSTRACT

The present invention relates to a wireline plug system for setting a permanent plug in a well for plugging and abandonment, comprising a wireline pumping tool comprising a pump powered from surface via a wireline, the pump comprising a pump inlet and a pump outlet, the wireline pumping tool having a first end connected to the wireline and a second end, a plugging and abandonment plug comprising a first plug end and an opening in the first plug end, and an engagement tool for releasably connecting the plug to the wireline pumping tool, the engagement tool having a through-bore fluidly connecting the opening in the first plug end with the pump outlet, wherein the plugging and abandonment plug comprises a tubular metal part and an expandable metal sleeve surrounding and connected to an outer face of the tubular metal part, the tubular metal part having an expansion aperture fluidly connecting an inside of the tubular metal part and a cavity between the expandable metal sleeve and the tubular metal part. The invention also relates to a wireline plug setting method for setting a permanent plug in a well for plugging and abandonment on the wireline.

14 Claims, 5 Drawing Sheets

(56) References Cited

U.S. PATENT DOCUMENTS

Figure 1A:
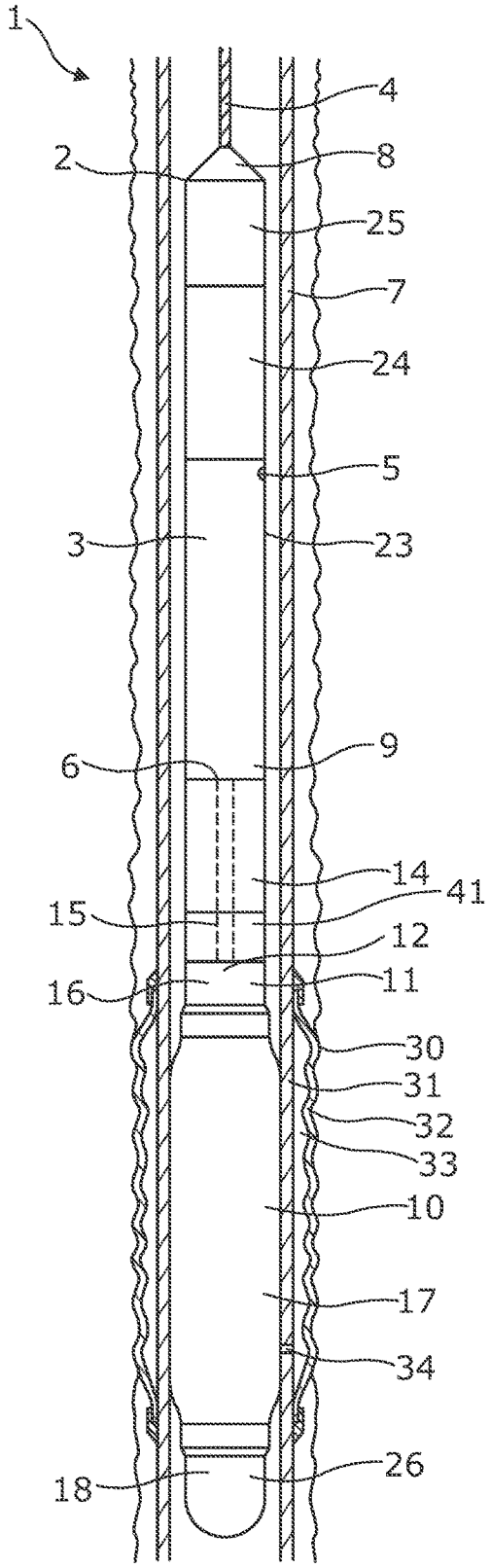

| | | | | |
|---|---|---|---|---|
| 2016/0024899 | A1* | 1/2016 | Lynn | E21B 43/26 166/305.1 |
| 2019/0178049 | A1 | 6/2019 | Kræmer | |
| 2019/0316437 | A1 | 10/2019 | Bårdsen et al. | |
| 2022/0098946 | A1* | 3/2022 | Hallundbæk | E21B 33/127 |

OTHER PUBLICATIONS

International Search Report and Written Opinion of the International Search Authority dated Jun. 28, 2022 in International Application No. PCT/EP2022/057898, 13 pages.
International Preliminary Report on Patentability dated Oct. 5, 2023 in International Application No. PCT/EP2022/057898, 8 pages.

* cited by examiner

WIRELINE PLUG SYSTEM

This application claims priority to EP 21165336.5 filed Mar. 26, 2021, the entire contents of which is hereby incorporated by reference.

The present invention relates to a wireline plug system for setting a permanent plug in a well for plug and abandonment. The invention also relates to a wireline plug setting method for setting a permanent plug in a well for plugging and abandonment on the wireline.

When a well becomes less productive, and all attempts to improve the production of hydrocarbons from a reservoir have failed, the unproductive part of the well, if not the whole well, is plugged and abandoned. The well is often abandoned by setting a cement plug in the casing by way of pouring cement into the well. Plugging and abandonment (P&A) is an important part of the lifetime of a well. It is also a costly process due to strict regulatory requirements for P&A operations to ensure that the well does not pollute the environment over subsequent years. The well designer often chooses to set bridge plugs in conjunction with cement slurries to ensure that high-density cement does not fall too far down the wellbore. In that case, the bridge plug would be set using drill pipe or coiled tubing, and cement would be pumped on top of the plug through a drill pipe string, after which the drill pipe string would be withdrawn before the slurry thickens. In other situations, the plug is set, and cement is pumped down through the plug, the cement thus being arranged underneath the plug before the plug is permanently closed for flow-through. Most plugs have complex designs for providing flow-through during insertion of the plug.

When planning a well, costs for plugging and abandonment (P&A) have to be guaranteed so that the authorities are not left with a large bill to pay for plug and abandonment (P&A), and a well operator therefore always seeks a less expensive solution for plug and abandonment to reduce the amount to be guaranteed. However, known plugs are expensive, and some fail to provide flow-through due to the complexity of the plug, as a result of which the plug cannot close the well as intended, and a new plug has to be inserted.

It is an object of the present invention to wholly or partly overcome the above disadvantages and drawbacks of the prior art. More specifically, it is an object to provide an improved plugging and abandonment system which is less complex and costly than known solutions.

The above objects, together with numerous other objects, advantages and features, which will become evident from the below description, are accomplished by a solution in accordance with the present invention by a wireline plug system for setting a permanent plug in a well for plugging and abandonment, comprising:

- a wireline pumping tool comprising a pump powered from surface via a wireline, the pump comprising a pump inlet and a pump outlet, the wireline pumping tool having a first end connected to the wireline and a second end,
- a plugging and abandonment plug having a first plug end and an opening in the first plug end, and
- an engagement tool for releasably connecting the plug to the wireline pumping tool, the engagement tool having a through-bore fluidly connecting the opening in the first plug end with the pump outlet, wherein the plugging and abandonment plug comprises a tubular metal part and an expandable metal sleeve surrounding and connected to an outer face of the tubular metal part, the tubular metal part having an expansion aperture fluidly connecting an inside of the tubular metal part and a cavity between the expandable metal sleeve and the tubular metal part.

By "plugging and abandonment plug" is meant a plug for "plug and abandonment" (P&A), i.e. a plug and abandonment plug (P&A plug).

Also, the pump may be configured to pump well fluid into the plug, the well fluid entering the pump through the pump inlet arranged in a housing of the pump.

A simple way of setting a plug downhole is thus obtained with no need for large equipment such as drill pipes or coiled tubing. The wireline plug system is lowered into the well by means of a wireline, and the pump pumps well fluid surrounding the tool in through the pump inlet and out into the plug. Thus, the wireline plug system uses the fluid already present in the well so that no other conditions are changed before the well is plugged and ready for cement to be poured onto the plug to provide fully approved "plug and abandonment" (P&A).

Furthermore, the wireline pumping tool may comprise an electric motor powered through the wireline for driving the pump.

Moreover, the electric section may be connected to the wireline with the electric motor.

In addition, the wireline pumping tool may be connected to the engagement tool, which is connected to the first plug end of the plugging and abandonment plug so that the engagement tool is arranged in between the wireline pumping tool and the plug.

Additionally, the electric motor may be arranged between the wireline and the wireline pumping tool.

Also, the well tubular metal structure may comprise an annular barrier, comprising a tubular metal part mounted as part of the well tubular metal structure and an expandable metal sleeve surrounding and connected to the tubular part, defining an annular barrier space fluidly connected to an inside of the tubular metal part via an expansion opening.

In addition, the plugging and abandonment plug may have a closed second end.

Moreover, the closed second end may be permanently closed.

Further, the closed second end may be closed when entering the well.

Also, the closed second end of the plugging and abandonment plug may have no valve or movable closing mechanism.

Furthermore, the expandable metal sleeve may comprise at least one sealing element arranged on an outer face of the expandable metal sleeve.

In addition, the first plug end may be connected to an engagement part having an inner face with an indentation for engagement with at least one dog of the engagement tool.

Moreover, the first plug end may be connected to an engagement part having an inner face with an indentation for engagement with at least one dog of the engagement tool in order to fasten the plug to the engagement tool.

The engagement part remains in the well when the engagement tool is disconnected from the plug.

Additionally, the engagement tool may further comprise a piston arranged in a round or annular bore, dividing the bore into a first bore part and a second bore part, the piston having a first piston end arranged in the first bore part fluidly connected to the through-bore by means of a hole so that fluid in the through-bore applies pressure on a first piston end, the piston having a second piston end extending into the second bore part, and the second piston end being fastened to the engagement part by means of a shear pin.

Furthermore, the first bore part may be fluidly connected with the expansion aperture.

Hereby the setting and the disconnection of the plug may be made in a simple way by increasing the pressure and in one operational run on wireline in well. This is a simple and safe way of disconnecting the tool from the plug, which is thus not dependent on the success of any other procedures such as cementing, closing a port or pulling in the wireline. Nor can a mistakenly executed upward pull cause the rupture of the shear screw prematurely, and there is no risk of cementitious material may block a pressure-actuated releasing pin mechanism such that it cannot be actuated.

In addition, the bore may be a round or annular bore.

Further, the piston may be tubular, surrounding the through-bore.

Also, the bore may be annular, surrounding the through-bore.

Furthermore, the engagement part may have a venting port fluidly connecting the second bore part with well fluid in the well.

The fluid in the second bore part can thus flow out into the well when the piston is pressed downwards towards the plug to break the shear pin.

In addition, the engagement tool may comprise a housing comprising a wall that comprises a first wall part facing the plug, the bore being arranged in the first wall part, and the hole being arranged in the wall between the bore and the through-bore.

Moreover, a first sleeve may surround a second wall part of the wall facing the pump, and the first sleeve and the second wall part may enclose an annular cavity in which a spring is arranged for forcing a second sleeve towards the at least one dog to keep the dog(s) in engagement with the indentation.

Further, the engagement part may surround the first wall part.

Also, the at least one dog may be arranged in an annular cavity between the engagement part and the first wall part.

Furthermore, the hole may be arranged in the wall, and the bore may be arranged in the wall.

Moreover, sealing elements may be arranged between the bore and the piston and may be arranged between the wall and the engagement part.

In addition, the engagement part may extend around the wall and the dogs.

Furthermore, the first plug end may be fastened to the engagement part, e.g. by a thread.

Also, the engagement tool may have a thread for connection to the pump.

In addition, the second wall part may be connected with the pump, e.g. via a connection part or directly to the pump.

Moreover, the second sleeve may comprise a projection part projecting through an opening in the housing.

Further, the second sleeve may comprise a projection part projecting through an opening in the housing to be able to mount the at least one dog in the indentation by pressing the projection part first in a first direction towards the pump, disengaging the at least one dog so that the at least one dog can enter the indentation, and subsequently the projection part is moved in the opposite direction of the first direction, the at least one dog engaging the indentation.

Also, a spring may be arranged between the second sleeve and the projection part to force the projection part towards the at least one dog.

When the projection part is moved in the first direction towards the pump, the spring is compressed.

Additionally, the wireline plug system may further comprise a driving unit, such as a downhole tractor, having wheels on arms for contacting an inner face of the well tubular metal structure to propel the wireline plug system forward in the well.

Furthermore, the driving unit may be powered by a second pump which is powered by a second electric motor, the second electric motor being powered by the wireline.

In addition, the present invention relates to a wireline plug setting method for setting a permanent plug in a well for plugging and abandonment (P&A) on the wireline, comprising:

- connecting a plugging and abandonment plug to an engagement tool of the wireline plug system,
- lowering the wireline plug system into a well,
- activating the pump of the wireline plug system,
- sucking well fluid surrounding the wireline plug system in through the pump inlet and out through the pump outlet via the through-bore and into the plug,
- setting the plug by pressurising the through-bore and the inside of the tubular metal part and expanding the expandable metal sleeve,
- further pressurising the through-bore for releasing the engagement tool from the plug, and
- retracting the engagement tool and leaving the plug in the well.

Moreover, further pressurising the through-bore so that pressure applied in the first piston end may cause the shear pin to break for releasing the engagement tool from the plug.

Finally, further pressurising may comprise moving the piston, breaking the shear pin.

Figure 1B:
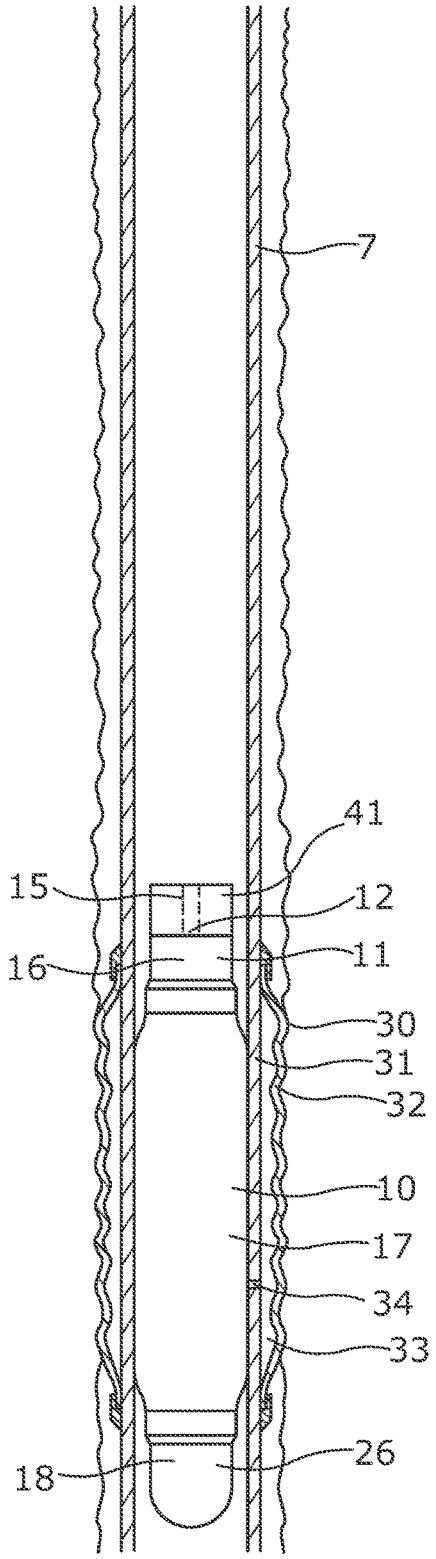
Figure 2A:
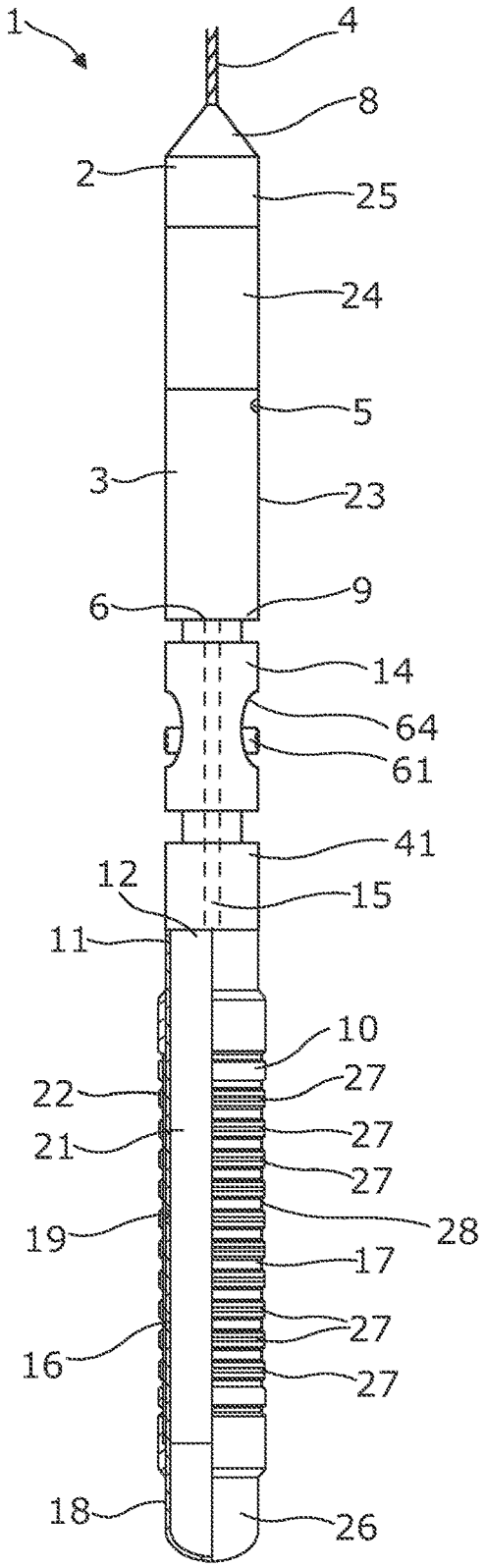
Figure 2B:
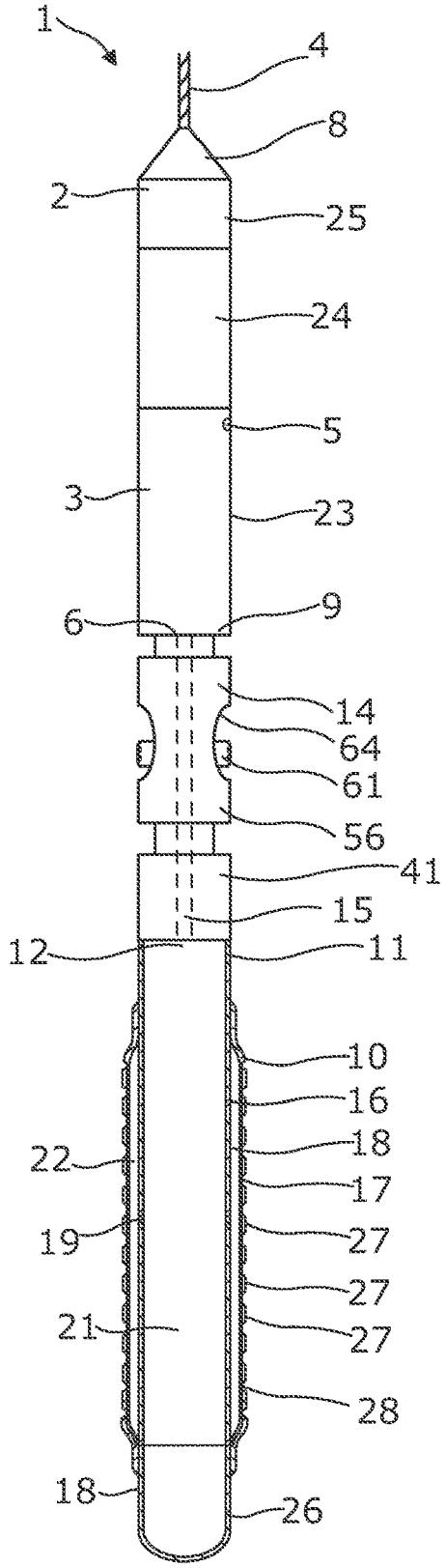
Figure 3:
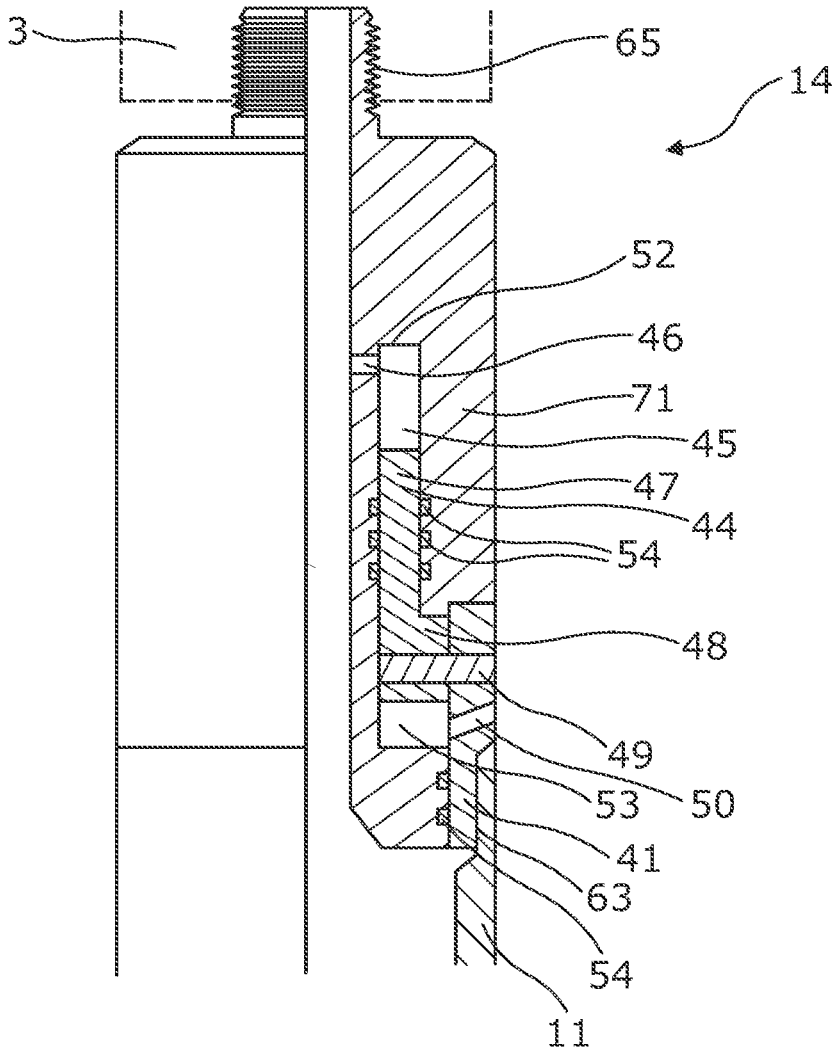
Figure 4:
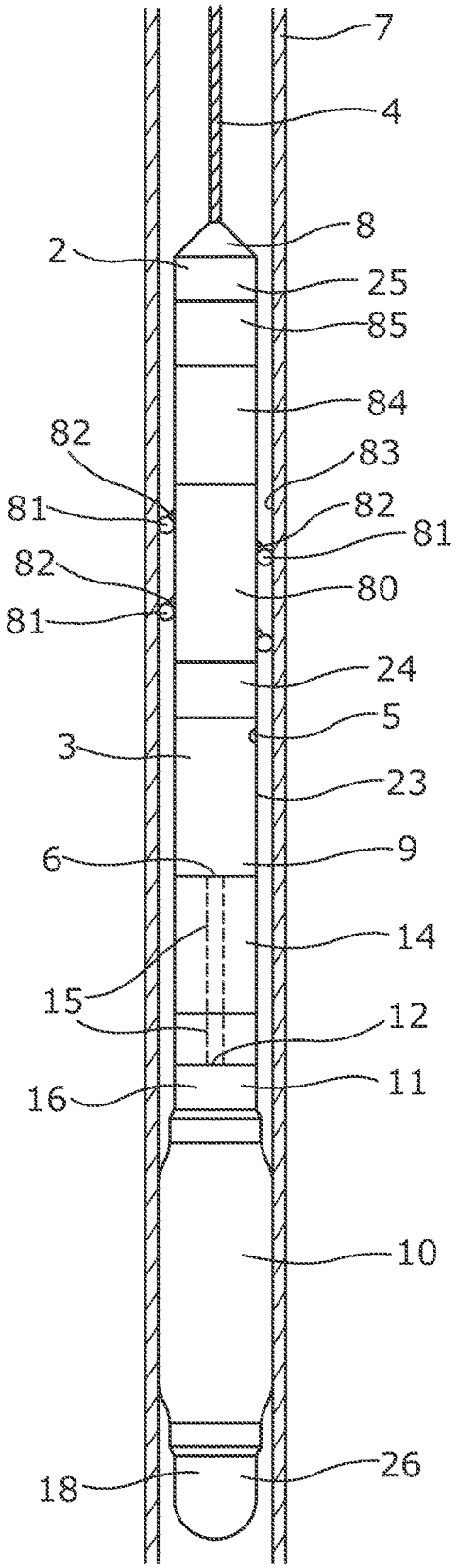
Figure 5:
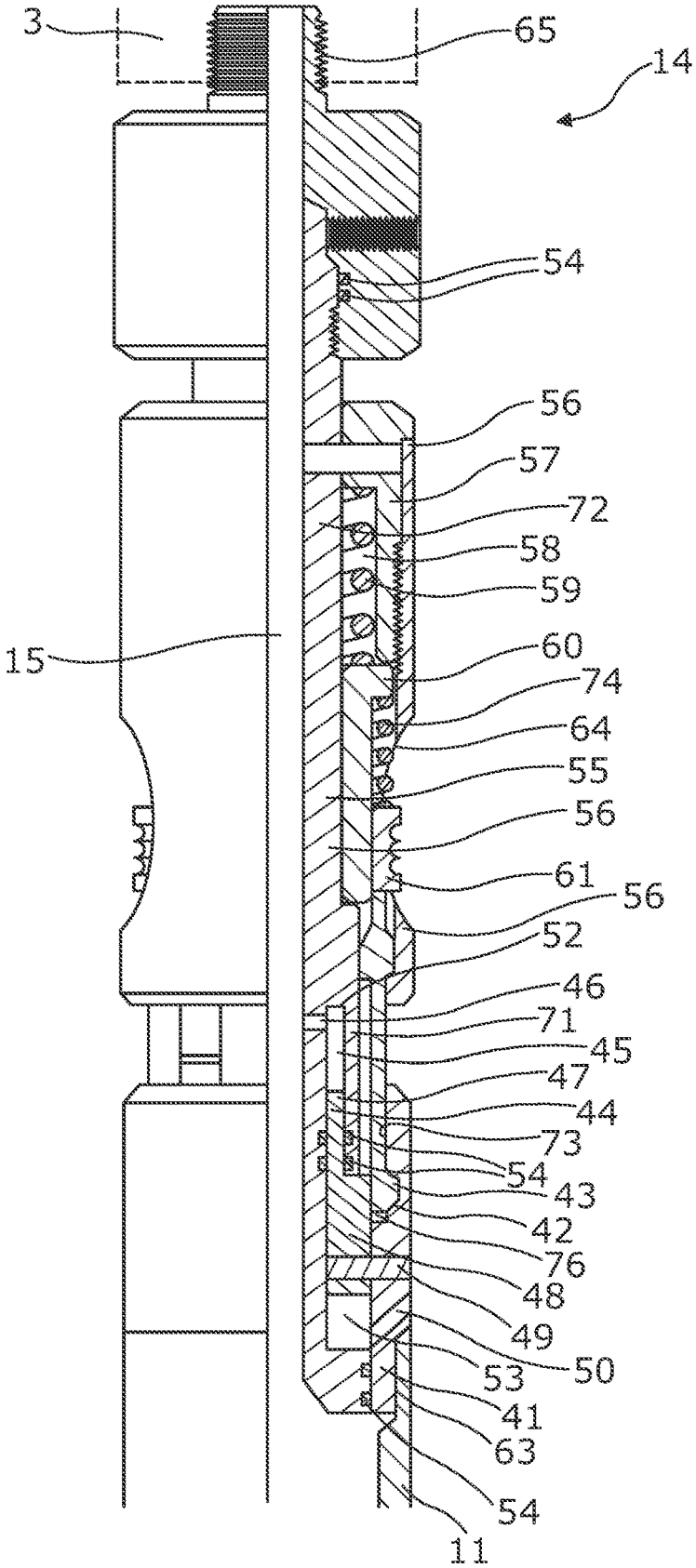

The invention and its many advantages will be described in more detail below with reference to the accompanying schematic drawings, which for the purpose of illustration show some non-limiting embodiments and in which:

FIG. 1A shows a partly cross-sectional view of a wireline plug system for setting a permanent plug in a well for plugging and abandonment, FIG. 1B shows a partly cross-sectional view of a part of the wireline plug system of FIG. 1A in which the plug has been set in a well, and the wireline pumping tool has been disconnected from the plug and retrieved from the well, FIG. 2A shows a partly cross-sectional view of another wireline plug system for setting a permanent plug in a well for plug and abandonment (P&A), FIG. 2B shows a partly cross-sectional view of the wireline plug system of FIG. 2A in which the plug has been set, FIG. 3 shows a partly cross-sectional view of an engagement tool connected to the first plug end of the plugging and abandonment plug, FIG. 4 shows a partly cross-sectional view of another wireline plug system having a driving unit for propelling the wireline plug system forward in the well, and FIG. 5 shows a partly cross-sectional view of another engagement tool connected to the first plug end of the plugging and abandonment plug.

All the figures are highly schematic and not necessarily to scale, and they show only those parts which are necessary in order to elucidate the invention, other parts being omitted or merely suggested.

FIG. 1A shows a wireline plug system 1 for setting a permanent plug 10 in a well for plugging and abandonment. The wireline plug system 1 comprises a wireline pumping tool 2 having a pump 3 powered from the surface via a wireline 4 and having a pump inlet 5 and a pump outlet 6.

The wireline pumping tool 2 has a first end 8 connected to the wireline 4 and a second end 9 facing downwards in the well. The wireline plug system 1 further comprises a plugging and abandonment plug 10 to be set in the well. The plugging and abandonment plug 10 has a first plug end 11 and an opening 12 in the first plug end 11. The wireline plug system 1 further comprises an engagement tool 14 for releasably connecting the plugging and abandonment plug 10 to the wireline pumping tool 2. The engagement tool 14 has a through-bore 15 fluidly connecting the opening in the first plug end 11 with the pump outlet 6. As shown in FIGS. 2A and 2B, the plugging and abandonment plug 10 comprises a tubular metal part 16 and an expandable metal sleeve 17 surrounding and being connected to an outer face 18 of the tubular metal part 16. The tubular metal part 16 has an expansion aperture 19 fluidly connecting an inside 21 of the tubular metal part 16 and a cavity 22 between the expandable metal sleeve 17 and the tubular metal part 16. In FIG. 1A, the plugging and abandonment plug 10 is in a set condition where the expandable metal sleeve 17 has been expanded to abut the wall of a well tubular metal structure 7 by activating the pump powered through the wireline 4 and pumping well fluid in through the pump inlet 5 in a housing 23 of the pump and out into the through-bore 15, into the inside 21 (shown in FIGS. 2A and 2B) of the tubular metal part 16 and out into the cavity 22 (shown in FIGS. 2A and 2B). In FIG. 1B, the engagement tool 14 has been disconnected from the plugging and abandonment plug 10 and left in the well.

A simple and easy way of setting a plug downhole is thus obtained, and there is no need for any large equipment such as drill pipes or coiled tubing. Thus, an improved plug and abandonment system which is less complex and costly than known solutions is obtained. The wireline plug system 1 is lowered into the well by means of the wireline 4, and the pump 3 pumps well fluid surrounding the tool in through the pump inlet 5 and out into the plug 10 by sucking in well fluid and using this to expand the expandable metal sleeve. Thus, the wireline plug system 1 uses the fluid already present in the well so that no other conditions are changed before the well is plugged and ready for cement to be poured onto the plug 10 to provide fully approved plugging and abandonment.

The plug is of metal, and when the expandable metal sleeve is expanded it creates a very strong plug able to carry the load of more than 100 meters of cement being poured onto the plug while the cement is hardening.

As shown in FIG. 1A, the wireline plug system 1 comprises an electric motor 24 powered through the wireline 4 for driving the pump 3 of the wireline pumping tool 2. An electric section 25 connects the wireline with the electric motor 24 for controlling the plug and abandonment operation in a well tubular metal structure 7. The wireline pumping tool 2 is connected to the engagement tool 14, which is connected to the first plug end 11 of the plugging and abandonment plug 10 so that the engagement tool 14 is arranged in between the wireline pumping tool 2 and the plug 10. The electric motor 24 is arranged between the wireline 4 and the wireline pumping tool 2.

The plugging and abandonment plug 10 has a closed second end 26. The closed second end 26 is permanently closed, and the closed second end 26 is closed when manufacturing the plug 10 and thus when entering the well. The second end 26 is merely a closed pipe in one end like a bullnose which is threadingly connected to the tubular metal part 16. Thus, the closed second end 26 of the plugging and abandonment plug 10 has no valve or movable closing mechanism, and the wireline plug system 1 thus provides simple and reliable plug and abandonment (P&A) which is less complex and costly than known solutions.

In FIGS. 1A and 1B, the well tubular metal structure 7 in which the wireline plug system 1 is arranged comprises an annular barrier 30, comprising a tubular metal part 31 mounted as part of the well tubular metal structure 7 and an expandable metal sleeve 32 surrounding and connected to the tubular metal part 31 defining an annular barrier space 33. The tubular metal part 31 further comprises an expansion opening 34 through which fluid enters for expanding the expandable metal sleeve 32 of the annular barrier 30.

In FIGS. 2A and 2B, the expandable metal sleeve 17 of the plugging and abandonment plug 10 comprises at least one sealing element 27 arranged on an outer face 28 of the expandable metal sleeve 17 to enhance the sealing ability of the plugging and abandonment plug 10 to the inner face of the well tubular metal structure 7. The sealing element 27 may be made completely of metal or of non-metal materials, such as elastomer, polytetrafluoroethylene (PTFE), graphene, graphite or similar materials.

The first plug end 11 is connected to an engagement part 41 of the engagement tool 14 so that the through-bore 15 fluidly connects the pump outlet 6 with the opening 12 in the first plug end 11 so as to fluidly connect the pump outlet 6 with the expansion aperture 19, fluidly connecting the inside 21 of the tubular metal part 16 and a cavity 22 between the expandable metal sleeve and the tubular metal part. The engagement tool 14 may be a modified GS pulling tool where the connection mechanism and the through-bore 15 are different from a conventional GS pulling tool.

In FIG. 3, the engagement tool 14 is shown in a partly cross-sectional view in order to disclose the releasable connection to the first plug end 11 of the plugging and abandonment plug 10. To the left of the centre line, the engagement tool 14 is disclosed as an outside view, and to the right the engagement tool 14 is shown as a cross-sectional view of the releasable connection. The releasable connection of the engagement tool 14 comprises a piston 44 arranged in a bore 45, dividing the bore into a first bore part 52 and a second bore part 53. The piston 44 has a first piston end 47 arranged in the first bore part 52 fluidly connected to the through-bore 15 by means of a hole 46 so that fluid in the through-bore 15 applies a pressure on the first piston end 47. The piston 44 has a second piston end 48 extending into the second bore part 53, and the second piston end 48 is fastened to the engagement part 41 by means of a shear pin 49. The piston 44 is tubular, surrounding the through-bore 15 and is arranged in the bore, which is annular and surrounds the through-bore 15. In another embodiment, the bore is a round hole and the piston acting therein is similarly circular. The first piston end 47 may have substantially the same thickness as the second piston end 48, or the second piston end 48 may be larger as shown, and the second piston end 48 abuts the engagement part 41 so that a common shear pin penetrates both the engagement part 41 and the second piston end 48. When the fluid pressure on the first piston end 47 exceeds the force required to shear/break the shear pin 49, the shear pin 49 breaks, the engagement part 41 is disengaged from the second piston end 48, and the plug 10 is released from the engagement tool 14.

Thus, the first bore part is fluidly connected with the expansion aperture. Hereby, the setting and the disconnection of the plug are made in a simple way by increasing the pressure and in one operational run on wireline in well. This is a simple and safe way of disconnecting the tool from the plug, which is thus not dependent on the success of any other procedures such as cementing, closing a port or pulling in the wireline. Nor can a mistakenly executed upward pull cause rupture of the shear screw prematurely, and there is no risk of cementitious material that may block a pressure-actuated releasing pin mechanism so that it cannot be actuated. Furthermore, most of the tool is retrieved from the well leaving only the engagement part 41 in the well and the more expensive part of the tool is retrieved.

In order to be able to move the piston 44 towards the plug 10, the engagement part 41 has a venting port 50 fluidly connecting the second bore part 53 with well fluid in the well. The fluid in the second bore part 53 can thus flow out into the well when the piston 44 is pressed downwards towards the plug 10 to break the shear pin 49.

The engagement tool 14 of FIG. 5 comprises a housing 56 having a wall 55, and the bore 45 is arranged in a first wall part 71 of the wall 55 facing the plug 10. The hole is arranged in the wall 55 between the bore 45 and the through-bore 15. The engagement tool 14 further comprises a first sleeve 57 surrounding a second wall part 72 of the wall facing the pump 3. As shown in FIG. 2A, the engagement part 41 remains in the well when the engagement tool 14 is disconnected from the plug 10.

In this way, a simple disconnection of the plug 10 is obtained after the plug has been set, in that when the fluid pressure on the first piston end 47 exceeds the force required to shear/break the shear pin 49, the shear pin 49 breaks, the engagement part 41 is disengaged from the second piston end 48, and the plug 10 is released from the engagement tool 14.

In the event that a shear pin 49 is not considered sufficient for the releasable connection between the engagement tool 14 and the plug 10, the engagement tool 14 may further comprise at least one dog 43 as shown in FIG. 5. The engagement part 41 of the engagement tool 14 has an inner face 73 with an indentation 42 which is in engagement with the at least one dog 43 of the engagement tool 14 in order to fasten the plug 10 to the engagement tool 14. The first piston end 47 has a smaller thickness than the second piston end 48 so that the second piston end 48 can abut the engagement part 41 and so that a common shear pin 49 penetrates both the engagement part 41 and the second piston end 48. When the shear pin is sheared, the piston moves towards the plug, and the dog 43 is free to disengage from the plug.

The first sleeve 57 and the second wall part 72 enclose an annular cavity 58 in which a spring 59 is arranged for forcing a second sleeve 60 towards the at least one dog 43 to keep the dogs 43 in engagement with the indentation 42. The engagement part 41 surrounds the first wall part 71, and the at least one dog 43 is arranged in an annular cavity 76 between the engagement part 41 and the first wall part 71. Sealing elements 54 are arranged between the bore 45 and the piston 44, and sealing elements 54 are arranged between the wall 55 and the engagement part 41. The engagement part 41 extends around the wall 55 and the at least one dog 43. The first plug end 11 is fastened to the engagement part 41, e.g. by a thread 63 or made one monolithic whole, and the engagement tool 14 has a thread 65 for connection to the pump 3. Thus, the second wall part 72 is connected with the pump 3, e.g. via a connection part or directly to the pump 3.

The second sleeve 60 comprises a projection part 61 projecting through an opening 64 in the housing 56 to be able to mount the dogs 43 in the indentation 42 by pressing the projection part 61 first in a first direction towards the pump 3, disengaging the dogs 43 so that the dogs 43 can enter the indentation 42, and subsequently the projection part is moved in the opposite direction of the first direction, the dogs 43 engaging the indentation 42. After moving the projection part 61 back again, the hole in the second piston end 48 is aligned with the hole in engagement part 41, and the shear pin 49 is pressed into the engagement part 41 and the second piston end 48, and the pressurising of the through-bore 15 to set the plug 10 can be initiated after running the plug in hole.

The engagement tool 14 further comprises a spring 74 being arranged between the second sleeve 60 and the projection part 61 to force the projection part 61 towards the at least one dog 43. When the projection part 61 is moved in the first direction towards the pump 3, the spring 74 is compressed, and once moving in the opposite direction, the spring 74 is in a more relaxed condition, but not fully relaxed.

In FIG. 4, the wireline plug system 1 further comprises a driving unit 80, such as a downhole tractor, having wheels 81 on arms 82 for contacting an inner face 83 of the well tubular metal structure 7 to propel the wireline plug system 1 forward in the well. The driving unit 80 is powered by a second pump 84, which is powered by a second electric motor 85, and the second electric motor 85 is powered by the wireline.

The wireline plug system 1 is operated according to a wireline plug setting method for setting a permanent plug 10 in a well for plugging and abandonment on a wireline. The method comprises connecting the plugging and abandonment plug 10 to the engagement tool 14 of the wireline plug system 1, lowering the wireline plug system 1 into a well, activating the pump 3 of the wireline plug system 1, sucking well fluid surrounding the wireline plug system 1 in through the pump inlet 5 and out through the pump outlet 6 via the through-bore 15 and into the plug 10, setting the plug 10 by pressurising the through-bore 15 and the inside of the tubular metal part 16, and expanding the expandable metal sleeve 17 until it abuts the wall of the borehole or well tubular metal structure. In order to release the engagement tool 14 from the plug 10, further pressurising of the through-bore 15 is performed by pressing onto the piston 44, moving the piston 44 and breaking the shear pin 49, and subsequently the engagement tool 14 is retracted, leaving the plug 10 in the well. When activating the pump 3, the pressure inside the through-bore 15 increases, and the plug 10 is set by expanding the expandable metal sleeve 17. By further increasing the pressure, the shear pin 49 breaks, and the engagement tool releases from the plug in that the engagement part 41 releases from the second piston end 48. The engagement part 41 thus remains with the plug 10 in the well.

A stroking tool is a tool providing an axial force. The stroking tool comprises an electric motor for driving a pump. The pump pumps fluid into a piston housing to move a piston acting therein. The piston is arranged on the stroker shaft. The pump may pump fluid out of the piston housing on one side and simultaneously suck fluid in on the other side of the piston.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

In the event that the tool is not submergible all the way into the casing, a downhole tractor 80 can be used to push the tool all the way into position in the well. The downhole tractor may have projectable arms 82 having wheels 81, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A wireline plug system for setting a permanent plug in a well for plugging and abandonment, comprising:

a wireline pumping tool comprising a pump powered from surface via a wireline, the pump comprising a pump inlet and a pump outlet, the wireline pumping tool having a first end connected to the wireline and a second end, a plugging and abandonment plug having a first plug end and an opening in the first plug end, and an engagement tool for releasably connecting the plug to the wireline pumping tool, the engagement tool having a through-bore fluidly connecting the opening in the first plug end with the pump outlet, wherein the plugging and abandonment plug comprises a tubular metal part and an expandable metal sleeve surrounding and connected to an outer face of the tubular metal part, the tubular metal part having an expansion aperture fluidly connecting an inside of the tubular metal part and a cavity between the expandable metal sleeve and the tubular metal part, and wherein the plugging and abandonment plug has a closed second end preventing fluid communication from the second plug end to the first plug end.

2. A wireline plug system according to claim 1, wherein the pump is configured to pump well fluid into the plug, the well fluid entering the pump through the pump inlet arranged in a housing of the pump.

3. A wireline plug system according to claim 1, wherein the wireline pumping tool comprises an electric motor powered through the wireline for driving the pump.

4. A wireline plug system according to claim 1, wherein the closed second end of the plugging and abandonment plug is without any valve or movable closing mechanism.

5. A wireline plug system according to claim 1, wherein the expandable metal sleeve comprises at least one sealing element arranged on an outer face of the expandable metal sleeve.

6. A wireline plug system according to any claim 1, wherein the first plug end is connected to an engagement part having an inner face with an indentation for engagement with at least one dog of the engagement tool.

7. A wireline plug system according to claim 6, wherein the engagement tool further comprises a piston arranged in a round or annular bore, dividing the bore into a first bore part and a second bore part, the piston having a first piston end arranged in the first bore part fluidly connected to the through-bore by means of a hole so that fluid in the through-bore applies pressure on the first piston end, the piston having a second piston end extending into the second bore part, and the second piston end being fastened to the engagement part by means of a shear pin.

8. A wireline plug system according to claim 7, wherein the engagement part has a venting port fluidly connecting the second bore part with well fluid in the well.

9. A wireline plug system according to claim 8, wherein the engagement tool comprises a housing comprising a wall that comprises a first wall part facing the plug, the bore being arranged in the first wall part, and the hole being arranged in the wall between the bore and the through-bore.

10. A wireline plug system according to claim 9, wherein a first sleeve surrounds a second wall part of the wall facing the pump, and the first sleeve and the second wall part enclose an annular cavity in which a spring is arranged for forcing a second sleeve towards the at least one dog to keep the dog(s) in engagement with the indentation.

11. A wireline plug system according to claim 10, wherein the hole is arranged in the wall, and the bore is arranged in the wall.

12. A wireline plug system according to claim 10, wherein the second sleeve comprises a projection part projecting through an opening in the housing.

13. A wireline plug system according to claim 12, wherein a spring is arranged between the second sleeve and the projection part to force the projection part towards the at least one dog.

14. A wireline plug setting method for setting a permanent plug in a well for plugging and abandonment on the wireline, comprising:

connecting a plugging and abandonment plug to an engagement tool of the wireline plug system according to claim 1, lowering the wireline plug system into a well, activating the pump of the wireline plug system, sucking well fluid surrounding the wireline plug system in through the pump inlet and out through the pump outlet via the through-bore and into the plug, setting the plug by pressurising the through-bore and the inside of the tubular metal part and expanding the expandable metal sleeve, further pressurising the through-bore for releasing the engagement tool from the plug, and retracting the engagement tool and leaving the plug in the well.

* * * * *